United States Patent [19]

Landgreen

[11] Patent Number: 4,552,427

[45] Date of Patent: Nov. 12, 1985

[54] SELF-LOCKING CONNECTOR

[75] Inventor: Eleanor A. Landgreen, Whittier, Calif.

[73] Assignee: International Telephone & Telegraph Corp., New York, N.Y.

[21] Appl. No.: 449,359

[22] Filed: Dec. 13, 1982

[51] Int. Cl.[4] ..... H01R 13/625

[52] U.S. Cl. ..... 339/89 M; 285/87; 339/90 R; 339/DIG. 2

[58] Field of Search ..... 339/89 R, 89 C, 90 R, 339/79, 89 M, DIG. 2, 91 R, 91 P; 285/87, 89, 88, 233, 348

[56] References Cited

U.S. PATENT DOCUMENTS

| | | | |
|---|---|---|---|
| 3,669,472 | 6/1972 | Nadsady | 285/87 |
| 3,786,396 | 1/1974 | Kemmer | 339/89 R |
| 3,917,373 | 11/1975 | Peterson | 339/89 R |
| 3,971,614 | 7/1976 | Paoli et al. | 285/89 X |
| 4,168,105 | 9/1979 | Herrmann, Jr. | 339/90 R |
| 4,290,662 | 9/1981 | Storcel | 339/89 M |
| 4,359,255 | 11/1982 | Gallusser et al. | 339/90 R |
| 4,472,013 | 9/1984 | Frear | 339/89 R |

FOREIGN PATENT DOCUMENTS

| | | | |
|---|---|---|---|
| 825579 | 12/1959 | United Kingdom | 339/DIG. 2 |

*Primary Examiner*—William R. Briggs

*Attorney, Agent, or Firm*—T. L. Peterson; R. C. Turner

[57] ABSTRACT

A self-locking connector is disclosed in which locking of the mating halves of the connector is achieved near or at complete mating of the connector. The locking mechanism comprises a cylindrical locking ring mounted in front of a detent ring which rotates with the coupling nut of the connector. The locking ring is formed with circumferentially extending slots providing narrow strips which are axially resilient. The strips carry locking tabs which are engageable with recesses in the detent ring.

18 Claims, 10 Drawing Figures

SELF-LOCKING CONNECTOR

BACKGROUND OF THE INVENTION

The present invention relates generally to a connector and, more particularly, to a self-locking connector in which uncoupling movement of the coupling nut of the connector is restrained.

While the present invention will be described specifically in connection with electrical connectors, it will be appreciated that the invention in adaptable for use with other forms of connectors, such as fiber optic connectors. Typically, the plug and receptacle connector members of an electrical connector are assembled together either by a bayonet type connection, or a threaded coupling nut. The threaded coupling nut has the most mechanical reliable configuration but, unlike the bayonet coupling arrangement, the threaded coupling nut does not inherently include means for resisting uncoupling when the connector is subjected to vibrations or means for audibly indicating when the mating halves of the connector are securely and firmly joined.

When connectors are utilized in aircraft and space vehicles, for example, they are often subjected to high vibrations. Consequently, connectors require some means for assuring that the mating halves of the connector will not uncouple, thus assuring electrical integrity during use of the connector. Furthermore, it is desirable to provide in a connector means which produces an audible indication of complete mating of the connector halves since the connectors may be located or mounted in virtually inaccessible locations where visual inspection of the connector is not possible.

Threaded electrical connectors have been developed which have a self-locking mechanism which produces an audible, and sometimes tactile indication of mating of the connector halves. For example, a U.S. Pat. No. 3,552,777 to Heinrich et al. discloses a self-locking electricial connector utilizing balls which cooperate with detents in a clicker plate. U.S. Pat. No. 3,808,580 to Johnson discloses a similar self-connector in which rounded projections are formed on a ring rather than a plurality of balls. U.S. Pat. No. 4,165,910 to Anderson discloses a self-locking connector in which a locking spring embodies radially extending fingers which engage detents formed on the inner surface of a coupling nut. U.S. Pat. No. 3,669,472 to Nadsady discloses a pipe coupling employing an annular ring on one coupling member having axially extending spring fingers cut out and bent forwardly therefrom which engage recesses formed in the mating coupler member. A similar locking spring is disclosed in U.S. Pat. No. 3,611,260 to Colardeau et al. All the aforementioned self-locking coupling arrangements have the disadvantage that the clicking or detenting occurs throughout the mating cycle so that there is not a clear indication of the fully mated condition of the connector assembly.

U.S. Pat. No. 3,594,700 to Nava et al. discloses a self-locking electrical connector employing a generally cylindrical locking ring which is slotted to provide narrow strips which are resilient radially so that projections formed on the strips may resiliently engage teeth formed on the inside of a coupling nut. The ring embodies an inwardly extending annular flange which is trapped between the shells of the mating connector members close to the end of the mating cycle to prevent rotation of the locking ring, so that continued rotation of the coupling nut will produce a clicking action when the detents thereon ride over the projections on the locking spring. U.S. Pat. No. 4,290,662 to Storcel discloses another form of a self-locking connector in which detenting occurs toward the end of the mating cycle by a cam ring being forced axially against detent protrusions formed on a wavespring washer behind the cam ring.

It is the object of the present invention to provide a relatively simple, low-cost and easy to assemble self-locking mechanism for a connector which is activated near or at the end of the mating engagement of the connector members and provides a clear audible indication of the fully mated condition of the connector.

SUMMARY OF THE INVENTION

According to a principal aspect of the present invention, there is provided a self-locking connector member, typically the plug connector member of a connector assembly, which has a self-locking arrangement associated with the coupling nut which is activated near or at the end of the mating engagement of the connector member with a second connector member, the receptacle, for resisting rotation of the coupling nut in the uncoupling direction of rotation thereof and producing an audible indication of complete mating. The self-locking arrangement includes a generally cylindrical locking ring which is fixed against rotation on the barrel of the plug connector member, and detent means providing a plurality of recesses surrounding the barrel and fixed to rotate with the coupling nut. The cylindrical locking ring has a section thereof resilient in the axial direction. Such section embodies a locking tab in front of the recesses and engageable with at least one of the recesses near or at the end of mating engagement of the connector halves.

In a preferred embodiment of the invention, the resilient section of the cylindrical locking ring is provided by forming a circumferentially extending slot in the ring thereby providing behind this slot a relatively narrow resilient strip on which the locking tab may be formed. The locking ring may be inexpensively stamped and rolled into cylindrical form, thus leading to a low-cost self-locking arrangement.

DESCRIPTION OF THE PREFERRED EMBODIMENTS

Figure 1:
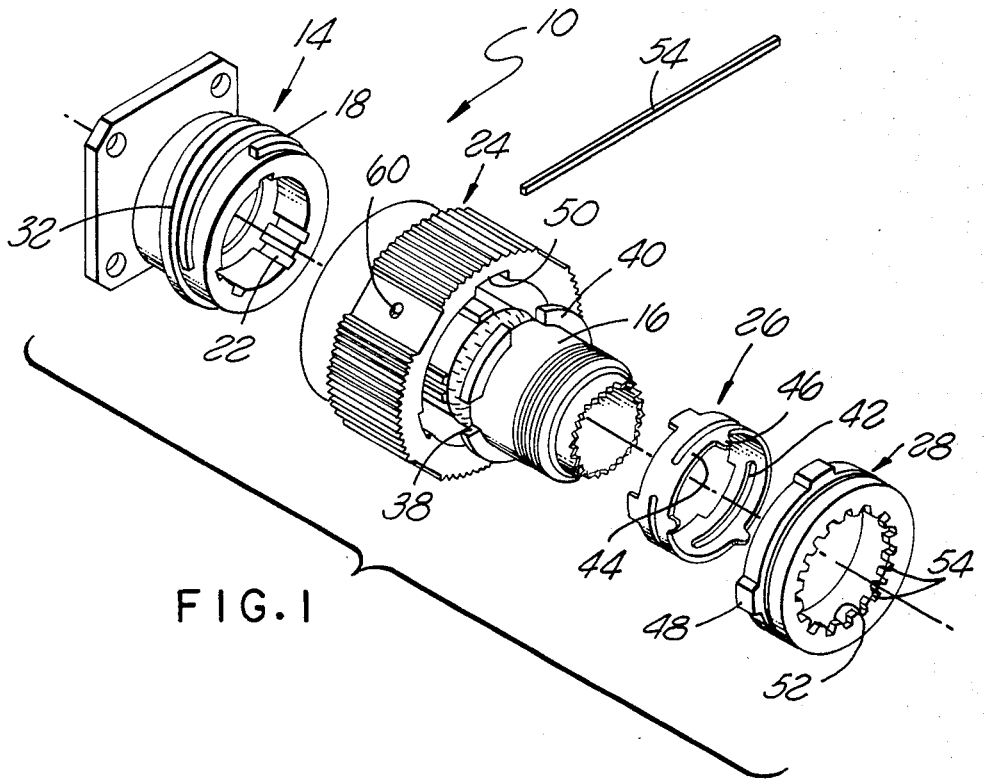
FIG. 1 is an exploded view of a self-locking plug connector member together with its mating receptacle connector member, constructed in accordance with one embodiment of the invention.
Figure 2:
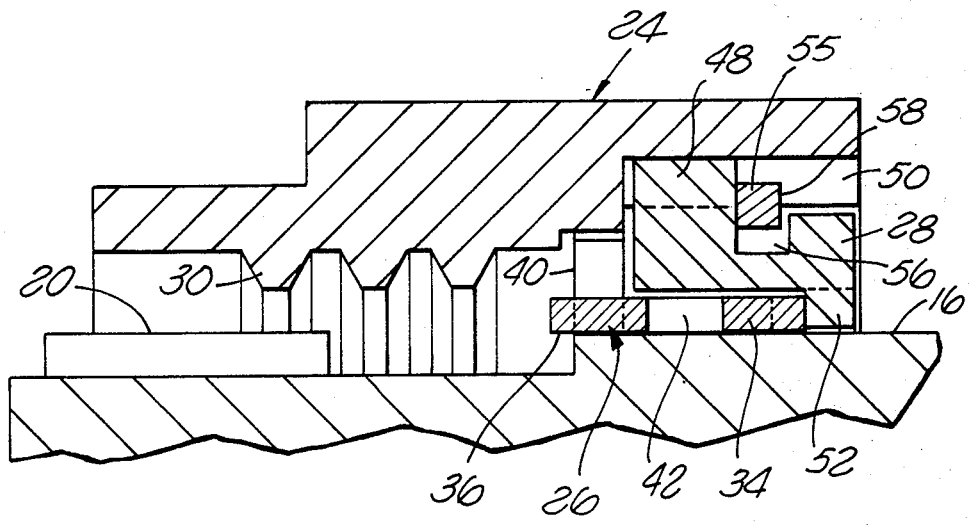
FIG. 2 is a partial longitudinal sectional view of the plug connector member illustrated in FIG. 1.

Reference is first made to FIGS. 1–5 of the drawings which illustrate one embodiment of the self-locking coupling mechanism of the present invention, such mechanism being incorporated in an electrical connector, generally designated 10. The connector comprises a plug connector member 12 which is adapted to mate with a receptacle connector member 14. In this embodiment of the invention, the self-locking mechanism is activated near but not at the very end of the mating cycle of the plug and receptacle members. Even so there is a clear audible indication of the fully mated condition of the connector. The plug connector member 12 comprises a barrel 16 which is adapted to contain a plurality of pin contacts which will mate with socket contacts, not shown, mounted in the shell 18 of the mating receptacle connector member 14. A plurality of keys 20, only one being visible in FIG. 2, are slidably engageable in keyways 22 formed in the interior of the shell 18 of the receptacle connector member to polarize the plug and receptacle members as is conventional in the art.

The coupling mechanism comprises a coupling nut 24, a locking spring 26 and a detent ring 28, all surrounding the barrel 16 of the plug connector members. The coupling nut is formed with internal threads 30 at its forward end which are adapted to engage threads 32 on the receptacle shell 18 for drawing the plug and receptacle connector members together when the coupling nut is rotated in the clockwise direction as viewed from the rear of the plug connector member.

The locking spring 26 is in the form of a cylindrical ring 34 having three forwardly extending protrusions 36 which extend forwardly through slots 38 formed in an outwardly extending annular flange 40 on the barrel 16. As best seen in FIG. 2, the protrusions extend in front of the flange 40 in a position where they will be engaged by the front end of the receptacle shell 18 when the plug and receptacle members are interengaged, whereby the locking spring will be forced rearwardly when the connector members approach final engagement. Three circumferentially extending slots 42 are formed in the cylindrical ring 34 between its front and rear edges. The slots are spaced from each other around the ring. Thus, there is provided behind each slot a relatively narrow resilient strip 44 which is deformable in the axial direction. A rearwardly extending locking tab 46 is formed in the intermediate region of each of the strips 44. The locking spring may be machined, or stamped from sheet metal and rolled into cylindrical form, the latter being the less expensive means for producing the spring.

The forward portion of the detent ring 28 extends over the locking spring 26. Four outwardly extending keys 48 are spaced around the perimeter of the detent ring 28, only two of such keys being visible in FIG. 1. The keys fit into complementary keyways 50 formed in the interior of the coupling nut 24 so that the detent ring will rotate with the coupling nut. A plurality of spaced teeth 52 are formed around the inner periphery of the detent ring 28 adjacent to its rear end, providing between the teeth spaced recesses 54 which are positioned behind the locking spring 26. The detent ring 28 is retained within the coupling nut by means of a flexible retaining wire 55 which is insertable into mating grooves 56 in the rings 28 and 58 in the interior of the coupling nut via a hole 60 which opens to the exterior of the nut as seen in FIG. 1.

As seen in FIG. 1, there may be three locking tabs 46 and eighteen recesses 54 in the detent ring. The greater the number of locking tabs, the resultant greater amount of ratcheting or clicking noise when the connector reaches its fully mated condition. As indicated previously, it is preferable that the self-locking clicking mechanism not become active until complete mating condition of the plug and receptacle members is closely approached. For example, if the coupling nut threads are designed so that full mating is achieved by 360° rotation of the coupling nut, preferably the locking tabs on the locking spring will not engage the recesses in the detent ring until the last 10° or 20° of rotation of the coupling nut, thus producing two or three clicks. The number of clicks will be dependent upon the number of locking tabs on the locking spring and the number of recesses in the detent ring.

Figure 5:
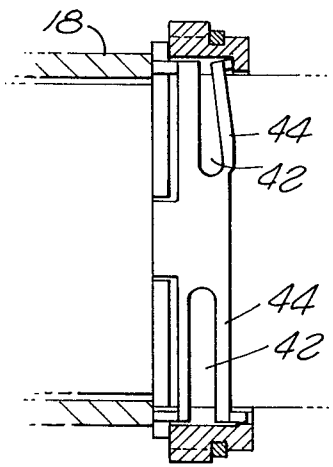
FIG. 5 is a further schematic illustration similar to FIGS. 3 and 4 but showing the condition of the locking spring and detent ring when the mating halves of the connector are fully interengaged whereupon the self-locking mechanism is fully activated.
Figure 4:
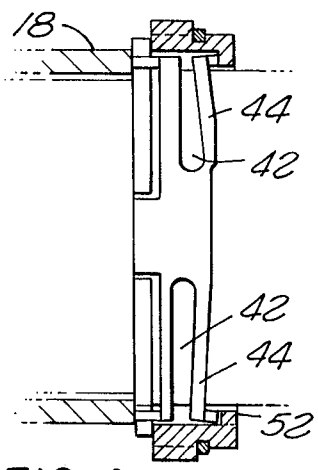
FIG. 4 is a schematic illustration similar to FIG. 3 showing the receptacle shell engaging protrusions on the locking spring urging it rearwardly during the mating cycle.
Figure 3:
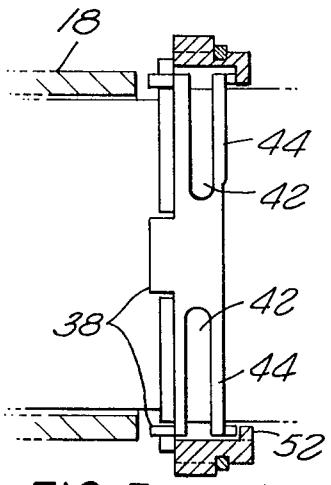
FIG. 3 is a somewhat schematic illustration showing the position of the locking spring and detent ring utilized in the self-locking plug connector member of the present invention when the plug and receptacle connector members are unmated.
Figure 6:
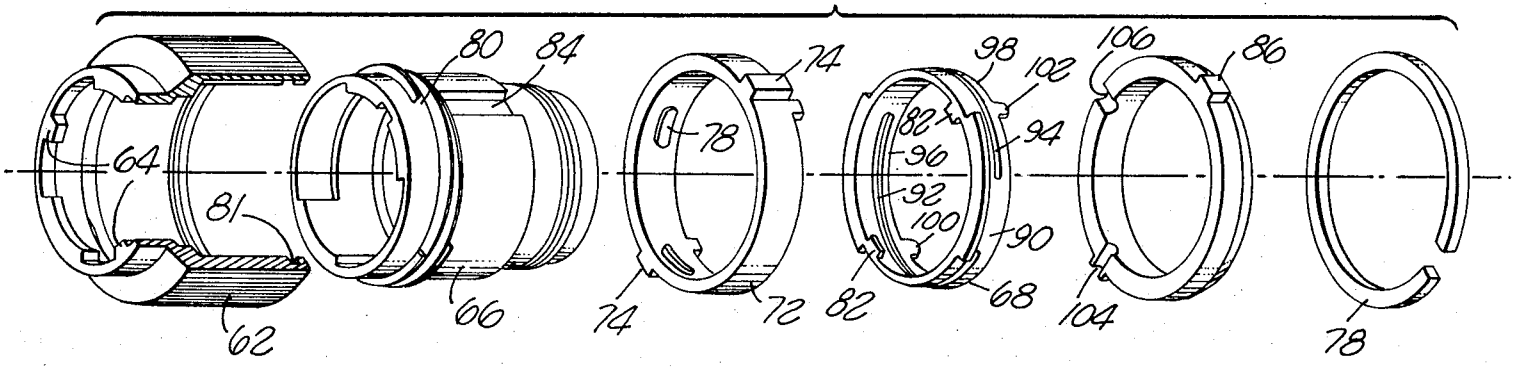
FIG. 6 is an exploded view of a further embodiment of the self-locking plug connector member of the present invention.
Figure 7:
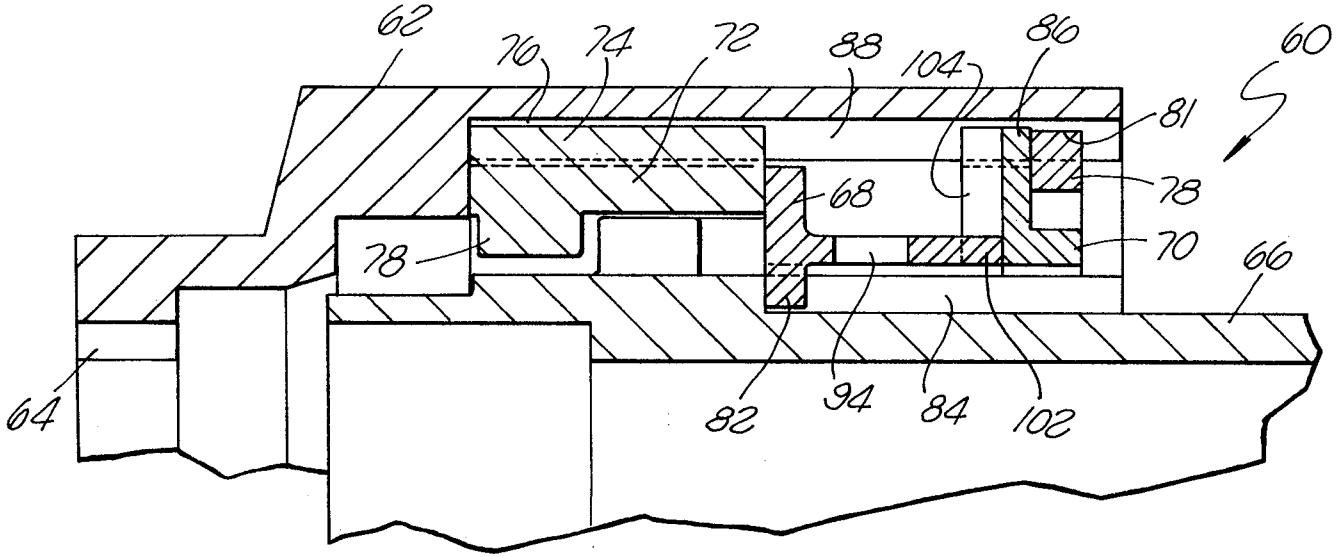
FIG. 7 is a partial longitudinal sectional view through the plug connector member illustrated in FIG. 6.

Reference is now made to FIGS. 3–5 for an illustration of the condition of the various parts of the self-locking mechanism of the connector during the mating sequence. Referring first to FIG. 3, when the plug and receptacle members are unmated, and the receptacle shell 18 is spaced from the forwardly extending protrusions 38 on the locking spring, and the tabs 46 on the spring are positioned forwardly of the recesses 54 in the detent ring. When the receptacle shell engages the protrusions 38, the locking spring is driven rearwardly causes the narrow resilient strips 44 on the rear portion of the locking spring to deflect axially in the forward direction relative to the detent ring, so that the tabs 46 on the strips will intermittently engage the recesses 54 in the detent ring, causing a detenting or racheting action to occur. Because the receptacle shell 18 is designed to engage the protrusions on the locking spring very close to the end of the mating cycle, the detenting action occurs essentially at the end of the mating cycle providing a relatively clear and concise audible indication of full mating occurring. In addition, the ratcheting produces a tactile indication of full mating of the connector.

Because of the deformation of the narrow strips 44 of the locking spring, a spring force is applied to the coupling nut through the detent ring which will resist rotation of the coupling nut in the counterclockwise, or uncoupling direction thereby providing a self-locking feature to the connector. When the coupling nut is rotated in the counterclockwise direction to uncouple the plug connector member from the receptacle connector member, the narrow strips 44 of the locking spring will return to the condition shown in FIG. 3 causing the protrusions 38 on the forward end of the spring to again project forwardly of the flange 40 on the plug barrel so that the locking spring will be automatically re-positioned for engagement again with the receptacle shell when the plug and receptacle members are recoupled.

Reference is now made to FIGS. 6–10 of the drawings which illustrate the second embodiment of the invention in which the self-locking coupling mechanism is incorporated in a breech lock type of electrical connector. The plug connector member 60 embodies a coupling nut 62 having inwardly extending spaced lugs 64 at its forward end which are adapted to interlock with lugs on the receptacle shell, not shown, when the coupling nut is rotated a relatively short distance, for example, 90°. In this embodiment of the invention, the self-locking mechanism is activated only at the end of the mating cycle so that there is no short prior ratcheting effect as in the first embodiment of the invention. But on the other hand, in this embodiment the locking mechanism is activated both when the plug connector member is in its mated and unmated condition to assure that the coupling nut 62 will be properly oriented with respect to the plug barrel 66 when the plug connector member is unmated from the receptacle connector member, not shown. The self-locking mechanism in the second embodiment of the invention includes a locking spring 68 and detent ring 70, similar to that used in the first embodiment of the present invention. In addition, in the breech lock arrangement illustrated in FIGS. 6–10 there is also included a coupling ring 72 between the barrel 66 and the coupling nut 62. The coupling ring embodies keys 74 engageable in keyways 76 in the coupling nut so that the ring 74 will rotate with the coupling nut. Angular lugs 78 are formed in the interior of the coupling ring which engage helical grooves 80 in the outside of the barrel 66 providing a threaded connection therebetween so that when the coupling nut engages the mating receptacle shell, the barrel 66 will be drawn forwardly via the coupling ring 74 to bring the contacts in the plug connector member into engagement with the contacts in the mating receptacle connector member.

The locking spring 68 is mounted behind the coupling ring 74 in the plug connector member, and the detent ring 70 is mounted behind the locking spring. The parts are retained in the coupling nut by a retaining ring 78 mounted in an annular groove 81 formed in the interior of the coupling nut. The locking spring embodies two inwardly extending lugs 82 which extend into axially extending grooves 84 in the outside of the barrel 66 thereby keying the locking spring to the barrel so that the spring will not rotate relative to the barrel, but permitting axial movement of the spring relative to the barrel. Outwardly extending keys 86 are formed on the detent ring which engage keyways 88 formed in the interior of the coupling nut so that the detent ring will rotate with the coupling nut.

The locking spring 68 is similar to a locking spring 26 in that it comprises a cylindrical ring 90 formed with circumferentially extending slots, two in number, one slot 92 being longer and wider than the other slot 94. The narrow strip 96 formed behind the slot 92 is therefore thicker than the narrow strip 98 formed behind the slot 94. However, because of the greater length of the slot 92, the narrow strip 96 is more resilient than the strip 98. A rearwardly extending locking tab 100 is formed on the resilient strip 96 between the ends of the slot 92. A second rearwardly extending projection 102 is formed on the strip 98 essentially diametrically opposed from the tab 100.

The detent ring embodies two notches 104 and 106 in its forward face, offset from each other 90°, corresponding to the angle of rotation of the coupling nut to achieve complete mating of the plug and receptacle connector members.

Figure 10:
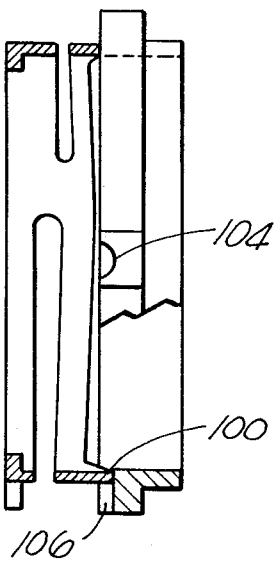
FIGS. 8, 9 and 10 are schematic illustrations showing the condition of the locking spring and associated detent ring during the unmated, partially mated and fully mated positions of the plug connector member with its mating receptacle connector member, not shown.
Figure 9:
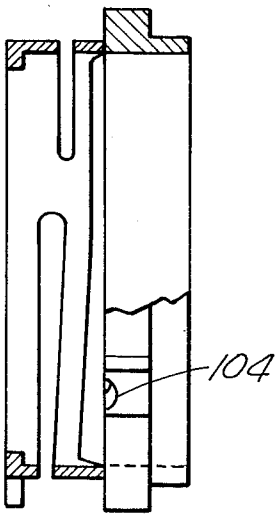
Figure 8:
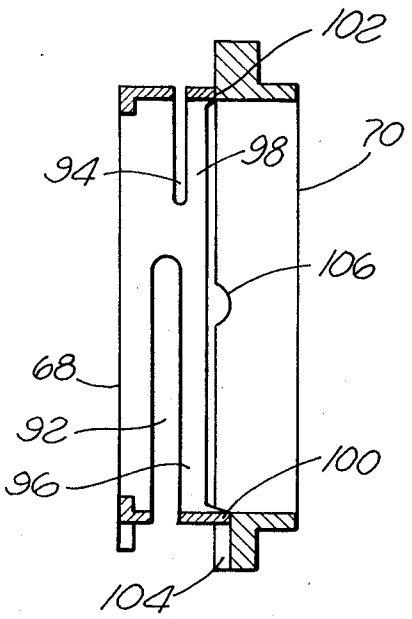

As best seen in FIG. 8, in this embodiment of the invention the locking tab 100 normally engages the notch 104 in the detent ring 70. The projection 102 is shorter than the locking tab 100, and bears against the front face of the detent ring. The projection 102 on the rear of the locking spring is provided to stabilize the spring in the assembly and provide for axial tolerance relief. When the plug connector member is mated with the receptacle connector member, the detent ring 70 is caused to rotate with the coupling nut, causing the locking tab 100 to disengage from the notch 104, due to the forward deflection of strip 96, and seen in FIG. 9 and enter the notch 106 after the coupling nut, and hence the detent ring, have rotated 90° as seen in FIG. 10. Thus, the locking tab 100 is positioned in one of two detent recesses 104 or 106, depending upon whether the connector member is in its mated or unmated condition. No ratcheting occurs as in the first embodiment of the invention. There is only a slight audible indication of full mating, but the snapping of the locking tab 100 into either of the notches 104 or 106 produces a tactile indication of full mating occurring. When the coupling nut is rotated in the counterclockwise direction to achieve uncoupling of the plug connector member from the receptacle connector member, the locking tab 100 will become repositioned in the notch 104 as illustrated in FIG. 8.

In either embodiment of the invention disclosed herein, the circumferentially slotted locking ring has the advantage that it is relatively simple to form by stamping and rolling, is relatively inexpensive, and because of its small thickness, allows a connector to be produced with a relatively small diameter coupling nut. The locking spring and detent ring of the locking mechanism of the present invention are easy to assembly to the barrel and coupling nut of the plug connecdtor member, thus leading to low-cost production. The amount of ratcheting that is desired can be altered by the number of recesses or notches formed in the detent ring, as well as the number of locking tabs on the locking spring. Furthermore, the force required to fully mate the connector members may be changed by altering during manufacture the length and width of the narrow strips on the locking ring which carry the locking tabs, as well as by altering the material of the locking spring.

What is claimed is:

1. A connector member adapted to mate with a second connector member comprising:

a barrel having rotatable coupling means thereon for drawing said connector members into mating engagement;

self-locking means associated with said barrel and said coupling means activated near or at the end of the mating engagement of said connector members for resisting rotation of the coupling means in the uncoupling direction of rotation thereof;

said self-locking means comprising a locking spring and detent means;

said locking spring comprising a generally cylindrical ring fixed against rotation on said barrel;

said detent means including means providing a plurality of circumferentially spaced recesses surrounding said barrel and fixed to rotate with said coupling means; and said cylindrical ring having a section thereof resilient in the axial direction, said section embodying a locking tab in front of said recesses and engageable with at least one of said recesses near or at the end of said mating engagement.

2. A connector member as set forth in claim 1 wherein:

said recesses are behind said locking spring; and said locking tab extends rearwardly from said resilient section of said cylindrical ring.

3. A connector member as set forth in claim 1 wherein:

said detent means comprises a separate detent ring keyed to said coupling means.

4. A connector member as set forth in claim 3 wherein:

said detent ring embodies a plurality of circumferentially spaced teeth on its inner surface providing said spaced recesses.

5. A connector member as set forth in claim 1 wherein:

said cylindrical ring embodies a forwardly extending protrusion engageable by said second connector member for shifting said ring rearwardly upon mating of said connector members to cause said locking tab to engage said recesses.

6. A connector member as set forth in claim 5 wherein:

said barrel embodies an outwardly extending flange having a slot therein, said protrusion extends through said slot in front of said flange prior to engagement of said connector members.

7. A connector member as set forth in claim 1 wherein:

said cylindrical ring embodies means for blocking engagement of said locking tab with said one recess until said end of mating engagement is reached.

8. A connector member as set forth in claim 7 wherein:

said blocking means comprises a rearwardly extending projection on said cylindrical ring facing said recesses.

9. A connector as set forth in claim 7 wherein:

said detent means includes only two recesses.

10. A connector member as set forth in claim 8 wherein:

said coupling means is rotated a predetermined angle less than 360° to fully mate said connector members; and said two recesses are offset from each other said predetermined angle.

11. A connector member as set forth in claim 1 wherein:

said cylindrical ring embodies a plurality of said locking tabs offset from each other at angles different than the angular spacing of said recesses whereby only one of said tabs will engage a recess at any instance.

12. A connector member as set forth in claim 2 wherein:

said cylindrical ring has a second section resilient in the axial direction; and said second section embodies a rearwardly extending projection facing said recesses for blocking engagement of said locking tab with said one recess until near or at mating engagement of said connector members.

13. A connector member as set forth in claim 12 wherein:

said first-mentioned and second resilient sections of said cylindrical ring comprise narrow arcuate strips of said ring formed by circumferentially extending slots cut in said ring.

14. A connector member as set forth in claim 1 wherein:

said resilient section of said ring comprises a narrow arcuate strip of said ring formed by a circumferentially extending slot cut in said ring.

15. A connector member adapted to mate with a second connector member comprising:

a barrel having rotatable coupling means thereon for drawing said connector members into mating engagement;

a generally cylindrical locking ring fixed against rotation on said barrel;

detent means surrounding said barrel and rotatable with said coupling means;

said detent means including means providing a plurality of circumferentially spaced recesses behind said cylindrical ring;

said cylindrical ring having a circumferentially extending slot therein providing said slot a resilient arcuate strip deformable in the axial direction; and a rearwardly extending locking projection on said strip engageable with said recesses to lock said connector members together.

16. A connector member as set forth in claim 15 wherein:

a second circumferentially extending slot is formed in said cylindrical ring circumferentially spaced from said first-mentioned slot, and providing behind said second slot a second resilient arcuate strip deformable in the axial direction; and said second strip embodies a second rearwardly extending projection facing said recesses.

17. A connector member as set forth in claim 16 wherein:

said second projection is engaged with one of said recesses at a time the other projection is disengaged from said recesses.

18. A connector member as set forth in claim 17 wherein:

there is an odd number of said projections and an even number of said recesses, or vice versa.

* * * * *